US006459061B1

(12) United States Patent
Kugle et al.

(10) Patent No.: US 6,459,061 B1
(45) **Date of Patent: *Oct. 1, 2002**

(54) SEGMENTED CONVEYOR SORTER

(75) Inventors: Stephen T. Kugle, deceased, late of Arlington, by Mitchell H. Kugle, administrator; Mark A. Bennett, Irving, both of TX (US)

(73) Assignee: Siemens Electrocom, L.P., Arlington, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/510,090

(22) Filed: Feb. 22, 2000

Related U.S. Application Data

(63) Continuation-in-part of application No. 09/255,190, filed on Feb. 22, 1999, now Pat. No. 6,246,023.

(51) Int. Cl.[7] ..... B07C 5/00

(52) U.S. Cl. ..... 209/583; 209/912; 198/370.04; 198/805; 104/290; 105/239

(58) Field of Search ..... 209/584, 583, 209/912, 916; 198/370.04, 805; 104/287, 290; 105/239

(56) References Cited

U.S. PATENT DOCUMENTS

| | | | | | |
|---|---|---|---|---|---|
| 3,167,192 | A | * | 1/1965 | Harrison et al. | 198/370.04 |
| 3,463,298 | A | * | 8/1969 | Harrison | 198/370.04 |
| 3,662,874 | A | | 5/1972 | Muller | 198/155 |
| 3,749,025 | A | * | 7/1973 | Girand | 104/25 |
| 3,974,909 | A | * | 8/1976 | Johnson | 198/155 |
| 4,004,681 | A | * | 1/1977 | Clewet et al. | 198/796 |
| 4,399,904 | A | * | 8/1983 | Canziani | 198/370.04 |
| 4,744,454 | A | * | 5/1988 | Polling | 198/365 |
| 5,489,017 | A | * | 2/1996 | Bonnet | 198/370.04 |
| 5,664,660 | A | * | 9/1997 | Prydts et al. | 198/370.04 |
| 6,246,023 | B1 | * | 6/2001 | Kugle | 209/584 |

OTHER PUBLICATIONS

"Recirculating Carrier Sortation Systems", Rapistan Systems, 1998.*

"S–2000 Tilt Tray Sorting System", Crisplant, Jul. 1998.*

Developing Systems that Move Industry, Scorpion brochure, Mantissa Corporation, 6 pages.

* cited by examiner

*Primary Examiner*—Tuan N. Nguyen
(74) *Attorney, Agent, or Firm*—Philip G. Meyers Law Office

(57) ABSTRACT

A sorter conveyor system according to the invention includes at least one endless conveyor loop including a rail. One or more conveyor segments are mounted on the rail. Each segment is a series of cart units each having wheel structures mounted for rolling movement along the rail, a carrier for carrying one or more items thereon, a selectively actuable mechanism for actuating the carrier laterally in at least one direction to unload an item from the carrier to an unloading station adjacent the conveyor loop, and a coupling mechanism for joining each cart unit in each series in a head to tail relationship. One or more drive elements are connected to one or more of the cart units and configured to permit the conveyor segment to be driven by a linear drive unit. A drive system is provided which includes a plurality of linear drive units, preferably linear induction motors (LIM's) disposed at spaced positions along the conveyor loop for driving each of the drive elements of the cart units in each segment, such that each conveyor segment can each be driven independently of each other conveyor segment by selective actuation of the linear drive units.

20 Claims, 4 Drawing Sheets

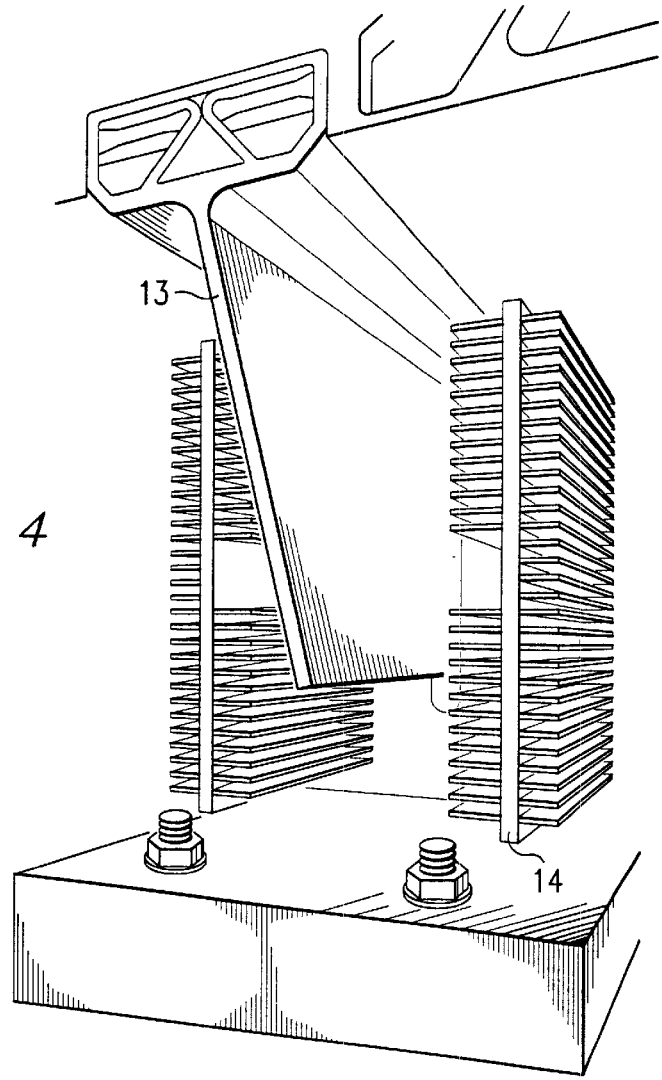
FIG. 4
FIG. 5
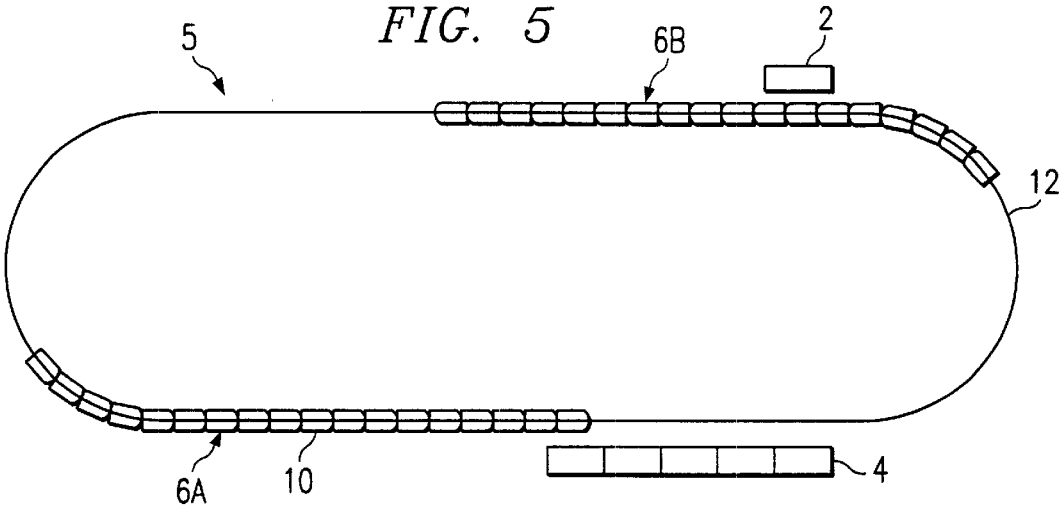

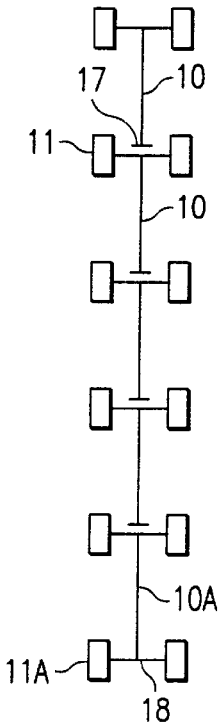
FIG. 6
FIG. 7
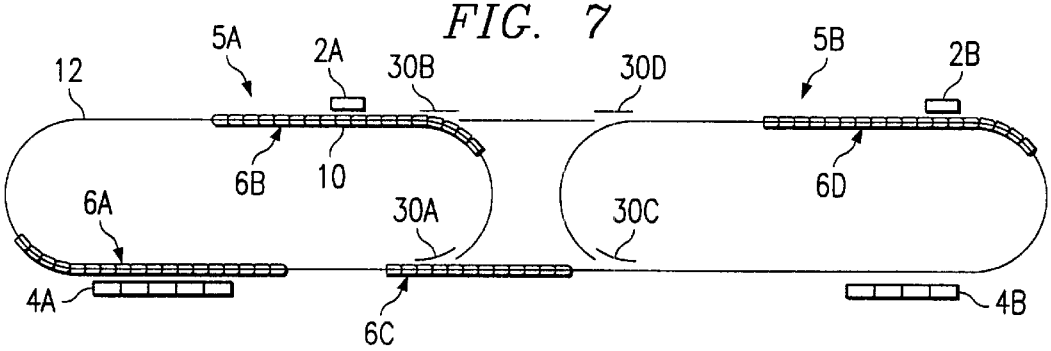
FIG. 8
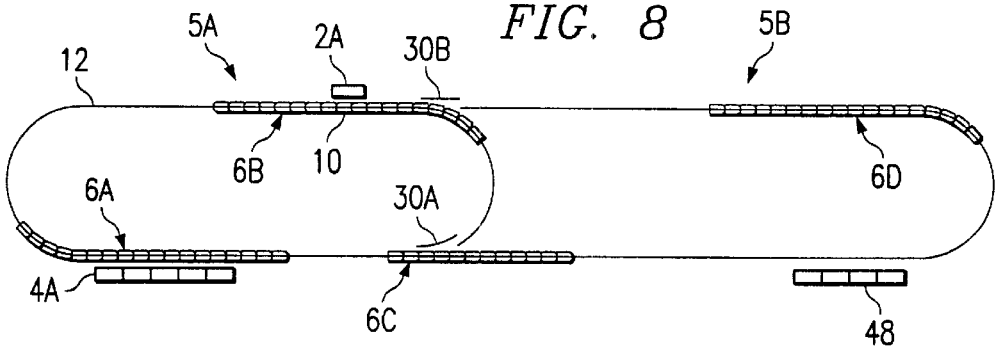

SEGMENTED CONVEYOR SORTER

This application is a continuation-in-part of U.S. Ser. No. 09/255,190, filed Feb. 22, 1999, now U.S. Pat. No. 6,246,023.

FIELD OF THE INVENTION

The invention relates to sorting using a conveyor, particularly to an apparatus and method for sorting items using multiple carts traveling around a closed loop.

BACKGROUND OF THE INVENTION

The postal system and high volume package shipping industry use tilt tray and cross-belt conveyor systems to sort bundles of letters and packages according to their respective destinations. Specialized sorters sort a bundle or package by destination zip code. During operation, an input stream of parcels is placed on a conveyor and sorted into multiple output streams. The conveyor sorts the packages by unloading them to either another appropriate conveyor or to an intermediate destination such as an unloading station. The unloading operation can be carried out with a tilt tray mechanism that tilts and ejects the package or bundle, or a cross-belt conveyor that unloads the item by means of a moving belt that conveys the item laterally.

Prior art tilt tray conveyor systems comprise a series of tilt tray carts linked together in a continuous loop. According to one known tilt tray conveyor system, the trays are secured to an endless drive chain, which pulls the trays around the loop. See Muller U.S. Pat. No. 3,662,874, issued May 16, 1972. According to another known tilt tray conveyor system known as the Mantissa Scorpion, linear induction motors (LIM's) are disposed at intervals around the loop for acting on a horizontally or vertically disposed plate (drive element) on each cart. The frame of each cart is T-shaped with a single axle, so that each cart depends on an adjoining cart for support.

Prior art cross belt sorters similarly comprise an endless loop of carts. Items to be conveyed are deposited on the cross-belt, which replaces a tray as the carrier. During unloading, an electric motor drives the conveyor so that the item is moved off the conveyor surface to one side or the other. See, for example, U.S. Pat. No. 5,690,209, issued Nov. 25, 1997 and also European Patent Application 927,689, published Jul. 7, 1999.

FIG. 1 illustrates a conventional loop 5 of LIM-driven tilt tray carts 10 connected head to tail and mounted on an endless, generally oval-shaped rail 12. The continuous loop of carts creates significant inefficiencies in the conveyor system. First, the system's strength depends literally on its weakest link. For example, if one cart 10 or its tray fails, the entire system must be stopped until the cart is repaired or replaced. Second, inefficient loading frequently occurs. The system may skip carts to maintain conveyor speed. This creates a situation in which empty carts are pulled around the loop, thereby resulting in wasted energy and system capacity. Additionally, some applications require large distances between input and output streams. Increased costs associated with longer cart chains may prohibit using a continuous chain conveyor system in a large loop.

Referring now to FIG. 2, transferring parcels between multiple loops 5A and 5B requires unloading the parcel from loop 5A and transferring it to the other loop 5B by a gravity slide 22 which feeds parcels to conventional conveyor belt 24. Belt 24 delivers the parcels to a powered induction station 26 which loads it onto a tray of a cart 10 in loop 5B.

The potential for parcel damage occurs with each transfer to and from the carts 10. This manner of transfer between loop 5A and loop 5B introduces many opportunities for the item to be damaged because moving an item to or from trays involves subjecting the item to forceful impacts.

Inefficiencies caused by the method of locomotion also exist. According to another known conveyor design called the NovaSort, a product of Siemens ElectroCom, L.P., a train or segment of tilt tray carts connected end to end is drawn by a leading cart having an engine in the manner of a monorail. The lead cart draws power from a sliding electrical contact on the rail. This design suffers the customary drawbacks of systems that rely on sliding electrical contacts. In addition, the carts of each segment contain a solenoid that actuates the tilting mechanism on each cart, thus adding to the weight and complexity of the system.

Accordingly, a low-maintenance cart system is needed that reduces the potential for parcel damage created by cart transfers between loops.

SUMMARY OF THE INVENTION

A sorter conveyor system according to the invention includes at least one endless conveyor loop including a rail. One or more conveyor segments are mounted on the rail. Each segment is a series of cart units each having wheel structures mounted for rolling movement along the rail, a carrier such as a tray or cross-belt for carrying one or more items thereon, a selectively actuable mechanism for unloading the carrier, such as by tilting a carrier tray laterally in at least one direction to unload an item to an unloading station adjacent the conveyor loop, and a pivotable coupling mechanism for joining each cart unit in each series in a head to tail relationship. One or more drive elements are connected to one or more of the cart units and configured to permit the conveyor segment to be driven by a linear drive unit. A drive system is provided which includes a plurality of linear drive units, preferably linear induction motors (LIM's) disposed at spaced positions along the conveyor loop for driving each of the drive elements of the cart units in each segment, such that each conveyor segment can each be driven independently of each other conveyor segment by selective actuation of the linear induction drive units. Other types of linear drive units, such as mechanical systems which directly pass momentum to the cart as it passes or systems which rely on forces other than magnetism, could also be used.

The first and last carts in each segments are connected to only one adjoining cart, that is, are not connected or adjacent to each other in a manner effective to form a continuous cart loop as in the prior art. Where the system has two or more cart segments, for example, selective control of the LIM's can be used to move one segment independently of other segments on the same rail, but without need for an "engine", i.e., a front or rear cart that pulls or pushes the series of carts in a manner analogous to a railroad train engine.

A linear drive unit as referred to herein means any form of conveyor drive, including both mechanical and linear induction, that exerts a force on a cart as it passes by, propelling the cart linearly (in the direction of the rail the cart is traveling on). The force may be exerted intermittently, as when a fin or plate on the cart passes by the linear drive unit, or continuously, as where the fin or plate spans multiple carts in the segment. In the alternative, spaced drive elements may be deployed on some carts and not others, such as on every other cart in the segment, as long as there are enough drive elements to keep the entire segment moving as required by the system design.

The invention further provides a method for sorting and conveying using a sorter conveyor system as described above. The method comprises the steps of moving the conveyor segment past a loading station, loading items onto the carriers of one or more of the carts as the carts pass the loading station, actuating the linear drive system to move the segment of carts past a row of unloading stations, and unloading items from the cart carriers to the unloading stations in accordance with a sorting scheme. Since the cart segment does not occupy the entire rail, the linear drive units may if desired be actuated only as a drive element of a cart is passing by. Similarly, two or more cart segments may be independently controlled on the same rail, for example, as where one is passing the loading station as the other is passing the unloading stations, after which the two cart segments exchange roles. These and other aspects of the invention are discussed in the detailed description which follows.

BRIEF DESCRIPTION OF THE DRAWINGS

The invention will hereafter be described with reference to the accompanying drawings, wherein like numerals denote like elements, and:

FIG. 4 is a partial perspective view of a LID with a drive element for the sorter of FIG. 3;

FIG. 5 is a schematic diagram of a segmented LID tilt tray sorter according to the present invention showing two segments;

FIG. 6 is a schematic diagram of a cart segment according to the invention.

FIG. 7 is a schematic diagram of a multi-loop segmented LID tilt tray sorter according to the invention showing a transfer system between loops;

FIG. 8 is an alternative form of the sorter of FIG. 7;

DETAILED DESCRIPTION OF PREFERRED EMBODIMENTS

Figure 1:
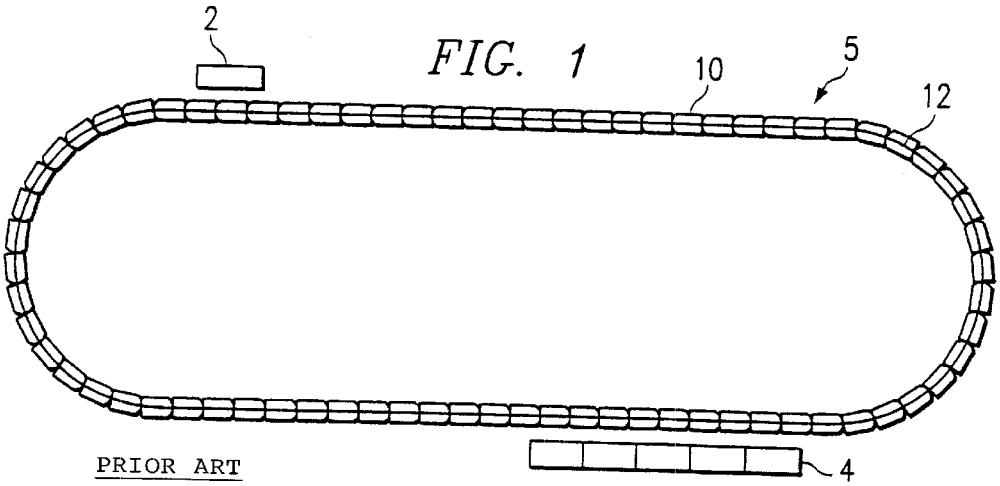
FIG. 1 PRIOR ART
FIG. 1 is a schematic diagram of a conventional linear induction drive (LID) tilt tray sorter tilt tray sorter) having carts connected head to tail.
Figure 2:
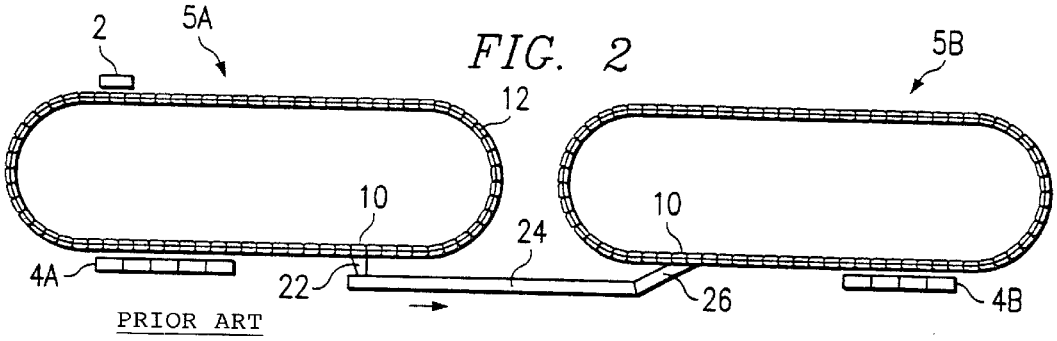
FIG. 2 PRIOR ART
FIG. 2 is a schematic diagram of a conventional method for transferring parcels between loops of tilt tray sorter systems.
Figure 3:
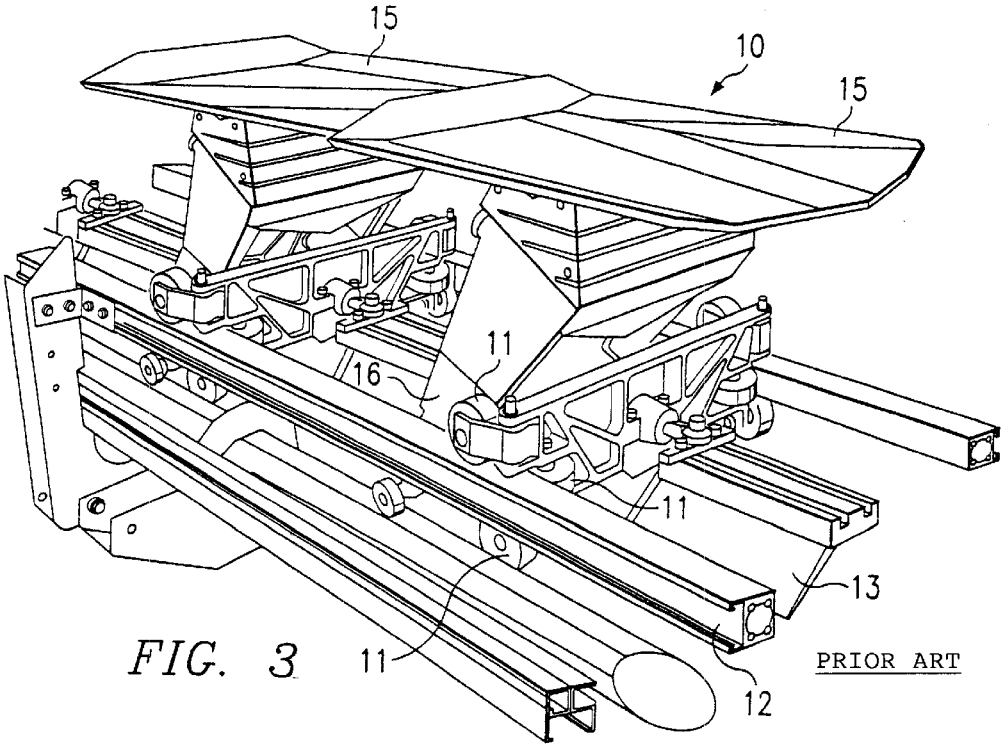
FIG. 3 PRIOR ART
FIG. 3 is a perspective view of conventional LID tilt tray sorter components usable in the present invention.

Carts for use in the present invention may be substantially the same as systems presently in use, such as those shown in U.S. Pat. No. 6,003,656, issued Dec. 21, 1999, the entire contents of which are incorporated by reference herein, but with certain key differences as described hereafter. As shown in FIGS. 3 and 4, carts 10 have rollers 11 that allow carts 10 to follow and move freely around the track 12. The undersides of carts 10 also have centrally mounted vertical linear induction drive elements 13. Electric linear induction motors (LIMs) 14 spaced around track 12 at regular intervals act upon linear induction drive elements 13 and propel carts 10. Each cart 10 is fitted with a tilt tray mechanism including a tiltable tray 15. A variety of items, for example packages, bundles of mail, or parcels, are loaded onto the trays 15 from a loading station 2 and conveyed around the track 12 until the item reaches a row of unloading stations 4. The items may be off-loaded into one or more output streams that correspond to a parcel's destination by selectively tilting trays 15 by actuating tilting mechanisms 16 to specific unloading stations 4 according to a sort scheme in a manner known in the art. The Mantissa Scorpion tilt tray conveyor system, made by Mantissa Corporation of Charlotte, N.C. is a preferred tilt tray mechanism for use in the present invention, but other commercially available tilt tray mechanisms could be used. Similarly, a cross-belt sorter or other known form of known cart unloading mechanism could be used in place of a tilt tray mechanism. See, for example, Kofoed U.S. Pat. No. 5,690,209, the contents of which are incorporated by reference herein.

Referring now to FIG. 5, a LID sorter according to the invention includes two independent segments 6A, 6B of carts on a single closed loop track 12. Because each cart has a linear induction drive element 13, LIMs 14 may drive each cart segment 6A, 6B independently around track 12. This feature eliminates the necessity of linking all carts 10 in a closed loop. Carts 10 used to make separately movable trains or cart segments 6A, 6B are most preferably Mantissa Scorpion LID carts as described above. However, as shown in FIG. 6, the Scorpion carts are essentially T-shaped and rely on each other for support as illustrated. Each cart 10 is joined by a suitable pivoting coupling, such as a ball and socket joint 17, tail to head with the cart behind it. Accordingly, the last cart 10A in the segment is preferably modified to have an additional set of rollers 11A and has a double axle rather than a single one. Rollers 11A may if necessary be provided with casters to permit cart 10A to travel around curves. The equivalent arrangement in reverse, wherein each cart frame is an inverted T-shape and the front cart 10 has the double axle, is also within the scope of the present invention. Thus, in the present invention it is most advantageous to have one double axle cart 10A per segment at an end position, while the remainder of the carts are single axle carts relying at one end for support on an adjacent cart 10 or 10A.

Multiple segments 6A, 6B allow greater flexibility in system design. Segments 6A, 6B may be operated with only the number of carts 10 necessary for a desired process. This eliminates the expense of extra carts that are only required to complete the chain around the loop. The length of each segment 6A, 6B may be adjusted to match the volume of packages conveyed to a particular location. Independently operating segments 6A, 6B on a single track allows for a more efficient sorting process. A LID sorter of the invention having several segments 6A, 6B of varying lengths can accommodate many different sorting processes. According to a preferred aspect of the invention, the spacing of LIMs 14 may vary from conventional spacing based on a predetermined minimum size for segments 6. The preferred minimum distance between adjacent LIMs in the main loops 5A, 5B is the length of the shortest segment 6, such that a segment 6 is always over at least one LIM 14.

FIG. 7 illustrates a LID sorter according to the invention have multiple loops or sub-loops 5A, 5B connected by a pair of parallel crossover tracks 28A, 28B and switches 30A–30D at opposite ends of each segment 28A, 28B. Each switch 30 has a movable track section 31A or 31B that operates in either a transfer position or a loop position in the manner of a railroad switch. In the transfer position, switch 30A directs a segment of carts 6C to follow interconnecting track 28A to transfer the segment from loop 5A to loop 5B as shown. In the loop position, switch 30B sends segment 6B around loop 5A.

Tracks 28A, 28B may be provided with spaced LIM's in the same manner as loops 5A, 5B. If tracks 28 are short in comparison to the cart segments, it may not prove necessary to provide spaced linear induction motors along tracks 28, since the LIM's of the respective loops and the momentum of the cart segments may be sufficient to make the transfer. On the other hand, if tracks 28 are long and transfers between loops 5A, 5B are rare, it may be more economical to find an alternative means for moving the segments along, such changing the elevation of the loops to rely on gravity to make the transfer, moving the cart segments manually, or providing a suitable propulsion system other than a linear induction drive which acts on the segment during transfer.

A multi-loop system according to FIG. 7 may be operated so that certain cart segments 6A and 6B, act as "local" carriers and remain on loop 5A and/or 5B at all times, whereas others (such as 6C) are regularly transferred at switches 30A–30D so that these segments circulate about the larger oval defined by both of loops 5A, 5B and tracks 28A, 28B. In the alternative, the sort scheme logic may be designed to cause crossover to occur any time a segment has been loaded with an item (or items) destined for unloading stations in each of rows 4A, 4B.

FIG. 8 illustrates a simplified version of the system of FIG. 7, wherein switches 30C, 30D are eliminated, resulting in a first small oval shaped loop 5A and a second, larger loop 5B created as an extension of loop 5A. Segments 6A–6D are loaded with items from a common loading station 2 on loop 5A. Segments 6A, 6B deliver only to a first row of local unloading stations 4A representing more common destinations, whereas segments 6C and 6D also unload at remote unloading stations 4B located on loop 5B representing less common destinations. This embodiment of the invention permits four segments 6A–6D to pass the more common unloading stations 4*a*, whereas only two segments pass and sort to the less common unloading stations 4B. At the single loading station 2, computer controlled sort scheme logic may, for example, ensure that items destined for one of unloading stations 4B are loaded onto one of segments 6C or 6D only.

Figure 9:
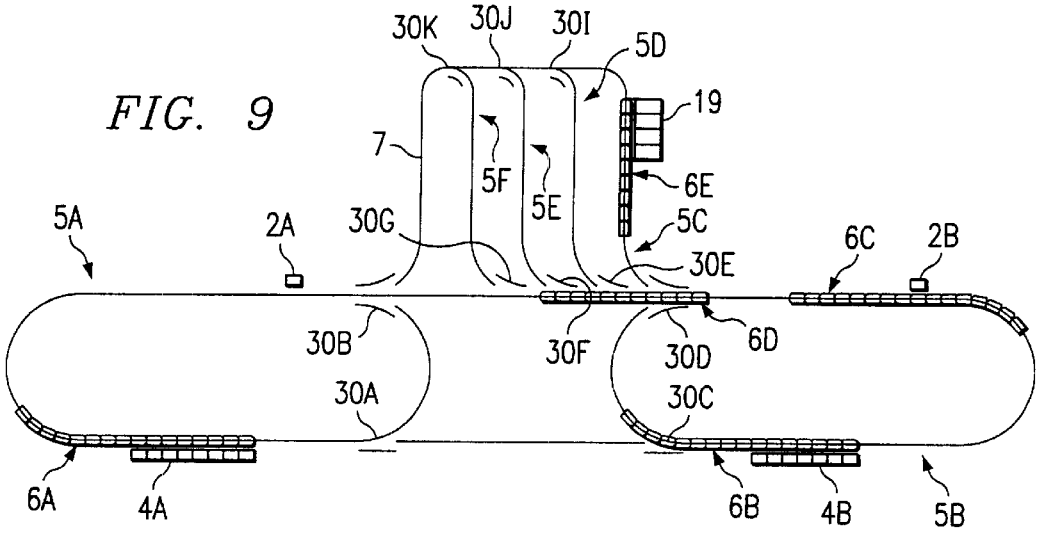
FIG. 9 is a schematic diagram of a segmented LID tilt tray sorter according to the invention having a set of sidetracks for isolating broken or out of service conveyor segments.

FIG. 9 shows a LID sorter according to the invention having several additional loops 5C to 5F which can serve as a holding area for carts with tray contents that require delayed delivery. One loop 5C can optionally be used as a "bone yard" or maintenance/storage area for an unused or broken cart segment 6E. In this embodiment, switches 30B and 30D may be three position switches as shown. Segments 6 may be transferred from the sorting loops 5A, 5B to one of the loops 5C–5F by associated switches 30D–30G. Loop 5C can provide an area separate from the active sorting process to perform preventative maintenance or repair work on the carts 10, and may adjoin a storage rack 19 for carts that have been removed from the system. A loaded or unloaded cart segment that has been diverted to one of loops 5D–5F can be reactivated when ready and moved through return switches 30I–30K along a common return track 7 and back into loop 5A through switch 30B.

Figure 10:
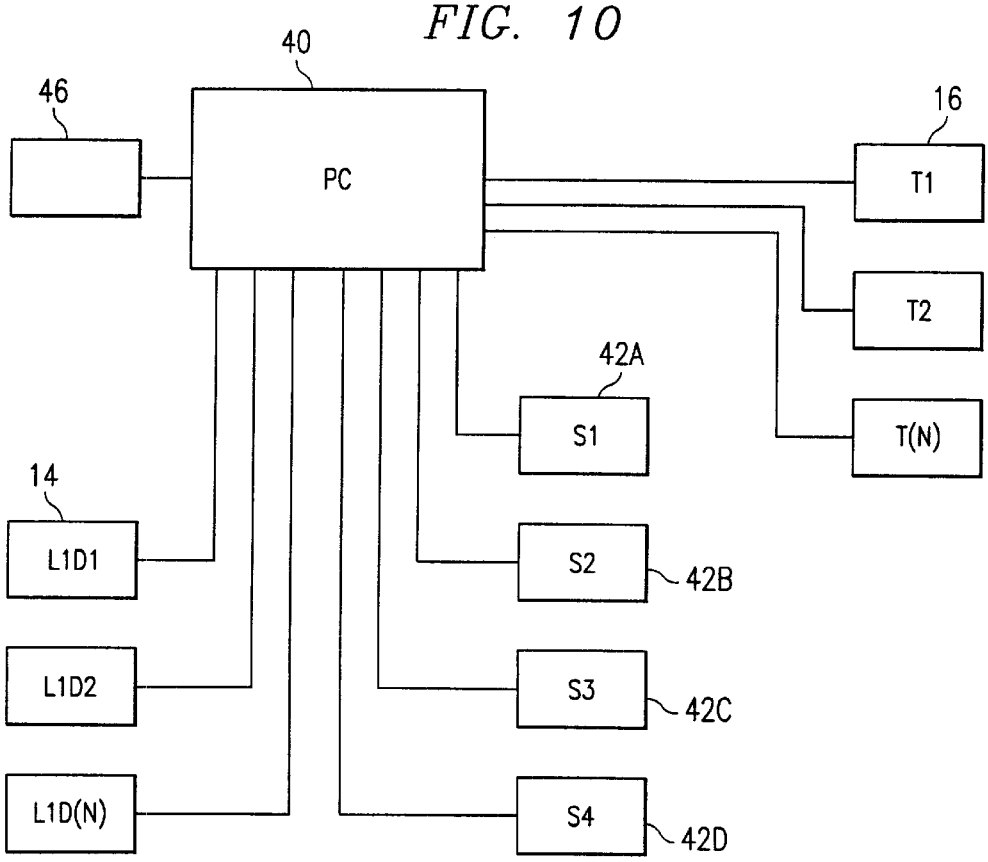
FIG. 10 is a schematic diagram of a segmented LID tilt tray sorter control system.

FIG. 10 shows one example of a sorter control system for operating a tilt tray sorting system of the invention as shown in FIG. 7. A personal computer 40 actuates a series of solenoids 42A–42D that control the switches 30A–30D. Computer 40 controls the LIMs 14, which drive carts 10, and the tilting mechanisms 16 which tilt the trays 15 for unloading at stations 4. Alternatively, computer 40 could control cross-belt carriers in the same manner as tilting mechanisms 16.

Programming computer 40 allows a user to automatically control the path and movements of segments 6A–6D in accordance with a predetermined sorting scheme. Each segment 6A–6D can be directed to sort items around the loops 5A, 5B (or enter one of the loops 5C–5F, in the embodiment of FIG. 9). Computer 40 also controls loading items onto the cart 10 at loading stations 2A, 2B as well as actuation of the tray tilt mechanisms 16 at specific unloading stations 4A or 4B.

For control purposes, it may prove useful to provide readable panels, such as reflective panels or light-scanable bar codes on each cart as so that unloading only occurs when the correct identification is detected at the unloading station, as for example, by scanning a bar code affixed to the cart frame. However, it may also prove possible using computer 40 to operate the system without uniquely identifying each individual cart for unloading purposes. By tracking the location of the lead cart in a segment 6 and storing data identifying the number of carts 10 in that segment and the respective contents relative to a corresponding row of unloading stations 4A or 4B, sorting logic may then be used to match each specific cart 10 with its respective unloading station 4. It may prove necessary in some cases to provide sensors throughout the loops 5A–5C, not merely proximate the unloading stations 4A, 4B, so that computer 40 knows the exact or approximate position of each segment 6A–6E at all times so that switching errors and the like can be avoided.

In a typical operation using the embodiment of FIG. 5, computer 40 receives information from a sensor 46 such as a bar code scanner concerning the destination of each of series of packages. The stream of packages is loaded from loading station 2 onto successive carts of a segment 6A. Computer 40 stores in memory a table of the item destination for each successive cart 10. Computer 40 also has in memory a table of the successive unloading stations 4 and the destination corresponding to each. As segment 6A passes the row of unloading stations 4, computer 40 activates the tilt mechanism of each cart 10 to be actuated when that cart 10 is in registration with the matching unloading station 4. As noted above, where the number of carts is known relative to the number of unloading stations and the carts are configured with the same spacing as the row of unloading stations, then the position of the lead cart sufficiently identifies the position of all carts in the segment for unloading purposes. However, to ensure accuracy, each cart may be detected as it enters each unloading station in a manner known in the art.

As segment 6A is unloading, the other segment 6B is loading at loading station 2, and the computer 40 operates LIM's 14 as needed to keep segments 6A, 6B in opposing positions on loop 5. Segments 6A, 6B then reverse roles again as segment 6B approaches unloading stations 4. Under conditions where less than all carts in a full loop are filled with items, this embodiment avoids wasted energy associated with driving empty carts continuously around the circle.

In the embodiment of FIG. 8, computer 40 additionally maintains in memory a table of common unloading stations 4A and rare unloading stations 4B. If a cart 10 is loaded with an item that must be unloaded at a rare destination 4B, then computer 40 operates switch 30A upon the approach of that cart segment 6 and sends it to pass by unloading stations 4B. In the alternative, the system may be controlled so that segments 6C, 6D always travel on loop 5B and pass by stations 4B, and segments 6A, 6B remain on loop 5A. Items destined for stations 4B are diverted and set aside to be loaded only onto one of carts 6C or 6D. Details of the specific control scheme will vary depending on the purpose for which the system is designed, and may be simple or complex as conditions dictate.

It will be understood that the foregoing description is of preferred exemplary embodiments of the invention, and that the invention is not limited to the specific forms shown, but is limited only by the scope of the invention as expressed in the appended claims.

What is claimed is:

1. A sorter conveyor system, comprising a conveyor loop including a rail;

at least one conveyor segment, which segment comprises a series of cart units each having wheel structures mounted for rolling movement along the rail, wherein a first and last cart in each segment are adjacent to only one other cart in that segment, each cart having a carrier for carrying one or more items thereon, a selectively actuable mechanism for actuating the carrier in at least one direction to unload an item from the carrier to an unloading station adjacent the conveyor loop, and a coupling mechanism for joining each cart unit in each series in a head to tail relationship, and wherein one or more drive elements are connected to one or more of the cart units and configured to permit the conveyor segment to be driven by a linear drive; and a drive system for driving each of the drive elements of the cart units in each segment.

2. A sorter conveyor system as recited in claim 1, wherein the conveyor loop has two parallel sections and two curved end sections.

3. A sorter conveyor system as recited in claim 1, wherein the conveyor loop further comprises two sub-loops and two switches permitting the segments to cross between the sub-loops.

4. The sorter conveyor system of claim 3, wherein the sub loops are spaced from each other, and the system further comprises first and second connecting rails permitting cart segments to travel between the spaced sub-loops.

5. A sorter conveyor system as recited in claim 3, wherein at least one loading station and a plurality of unloading stations are positioned proximate one sub-loop, and a storage facility is positioned proximate the other loop.

6. A sorter conveyor system as recited in claim 1, further comprising a computerized control system that operates the drive units in a manner effective to control movement of the cart segment.

7. A sorter conveyor system as recited in claim 6, wherein the system has at least two conveyor segments, and each conveyor segment can each be driven independently of each other conveyor segment by selective actuation of the linear induction drive units.

8. A sorter conveyor system as recited in claim 1, wherein each cart segment has a length sufficiently great so that each segment is positioned over at least one linear induction drive unit at all positions on the conveyor loop.

9. The sorter conveyor system of claim 1, wherein the drive system comprises a plurality of linear induction drive units disposed at spaced positions along the conveyor loop for driving each of the drive elements of the cart units in each segment.

10. The sorter conveyor system of claim 1, wherein the carriers comprise trays and the selectively actuable mechanism for actuating the carrier comprises a tilt mechanism that tilts the tray laterally selectively to unload an item.

11. The sorter conveyor system of claim 9, wherein the carriers comprise trays and the selectively actuable mechanism for actuating the carrier comprises a tilt mechanism that tilts the tray laterally selectively to unload an item.

12. A method for sorting and conveying using a sorter conveyor system, which system includes a conveyor loop including a rail, at least one conveyor segment, which segment comprises a series of cart units each having wheel structures mounted for rolling movement along the rail, wherein a first and last cart in each segment are adjacent to only one other cart in that segment, each cart having a carrier for carrying one or more items thereon, a selectively actuable mechanism actuating the carrier in at least one direction to unload an item from the carrier to an unloading station adjacent the conveyor loop, and a coupling mechanism for joining each cart unit in each series in a head to tail relationship, and wherein one or more drive elements are connected to one or more of the cart units and configured to permit the conveyor segment to be driven by a linear drive, and a drive system including a plurality of linear drive units disposed at spaced positions along the conveyor loop for driving each of the drive elements of the cart units in each segment, which method comprises the steps of:

moving the conveyor segment past a loading station;

loading items onto the trays of one or more of the carts as the carts pass the loading station;

actuating the linear drive system to move the segment of carts past a row of unloading stations; and unloading items from the cart carriers to the unloading stations in accordance with a sorting scheme.

13. The method of claim 12, further comprising actuating the linear induction drive units to operate only when a cart segment is passing each linear induction drive unit.

14. The method of claim 12, wherein the endless conveyor loop further comprises two sub-loops and two switches permitting the segments to cross between the sub-loops, and the method further comprises operating one of the switches as the first cart in a conveyor segment approaches the switch to cause the conveyor to travel from one sub-loop to the other.

15. The method of claim 12, further comprising independently operating two or more conveyor segments on the one common rail.

16. The method of claim 12, wherein the items comprise bundles of mail.

17. The method of claim 12, wherein the items comprise packages.

18. The method of claim 12, wherein the drive system comprises a plurality of linear induction drive units disposed at spaced positions along the conveyor loop for driving each of the drive elements of the cart units in each segment.

19. The method of claim 12, wherein the carriers comprise trays and the selectively actuable mechanism for actuating the carrier comprises a tilt mechanism that tilts the tray laterally selectively to unload an item.

20. The method of claim 19, wherein the carriers comprise trays and the selectively actuable mechanism for actuating the carrier comprises a tilt mechanism that tilts the tray laterally selectively to unload an item.

* * * * *